United States Patent [19]

Chern

[11] Patent Number: 4,479,501

[45] Date of Patent: Oct. 30, 1984

[54] CASSETTE TYPE HYGIENIC COMB AND BRUSH

[76] Inventor: Horng Y. Chern, 10-4 Fl., No. 62, Chang-Chun Rd., Taipei, Taiwan

[21] Appl. No.: 365,831

[22] Filed: Apr. 5, 1982

[51] Int. Cl.[3] ..... A45D 44/18

[52] U.S. Cl. ..... 132/85; 132/9; 15/87

[58] Field of Search ..... 132/85, 9; 15/87, 98

[56] References Cited

U.S. PATENT DOCUMENTS 3,818,916 6/1974 Meyer ..... 132/85

4,307,739 12/1981 Chern ..... 132/85

*Primary Examiner*—G. E. McNeill

[57] ABSTRACT

A cassette type hygienic comb and brush comprises a basic body (1) and a cassette bristle holder (2), which is formed with a plurality of thin film layers (26) removably held atop thereon with the bristles (27) extending through the layers and is engaged with the back (10) of the body (1) for cleansing or combing use and may be replaced with a new cassette bristle holder for continuous service after the thin film layers being completely torn off.

10 Claims, 14 Drawing Figures

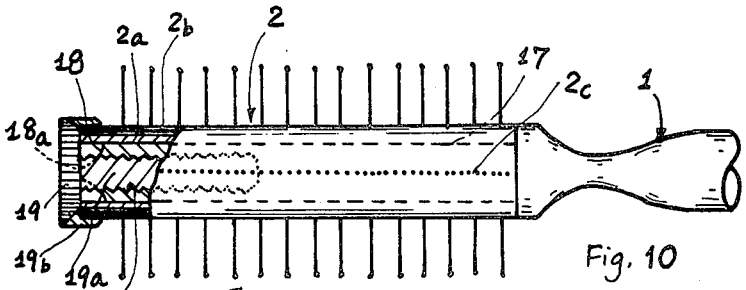
Fig. 10
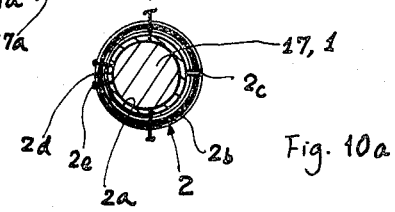
Fig. 10a
Fig. 11
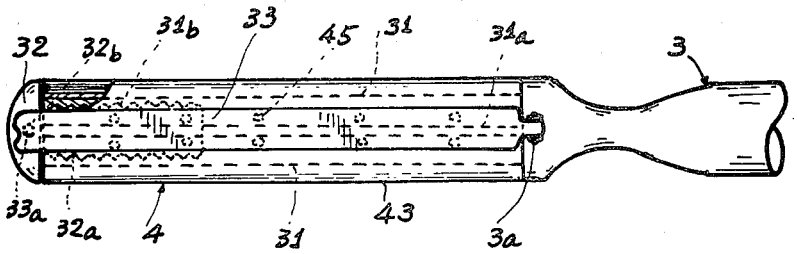
Fig. 12
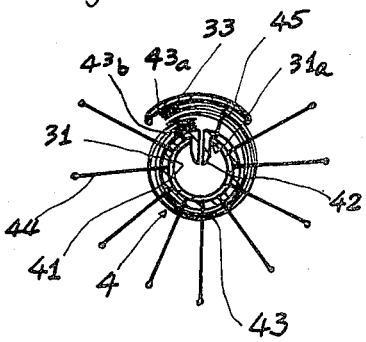
Fig. 13
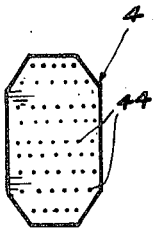

CASSETTE TYPE HYGIENIC COMB AND BRUSH

BACKGROUND OF THE INVENTION

The conventional comb or brush will accumulate hair or dust on the bristles of comb or brush after being used for a time. To cleanse or wash the comb or brush by hand will cause inconvenience and may contaminate user's fingers or may introduce bacteria.

U.S. Pat. No. 4,307,739 of hygienic comb and brush invented by the present inventor discloses a hygienic comb and brush in which a plurality of thin film layers are removably held atop each other on the comb base with the bristles extending through the layers so that it can be cleaned by removing a film. A copy of the specification and drawings of this patent is enclosed herewith as a reference. However, such a patent may still remain the following defects:

1. Each thin film layer extends over the handle portion of a comb and brush for a distance to waste film material and is thus easily broken when tearing off a film.

2. Each layer extends to a different length on the handle, which will increase the production complexity.

3. All the thin film layers are held on a comb base which is sturdily fixed on the comb back. The new film layers can not be repeatedly installed on the comb or brush, thereby causing loss on an economic point of view.

The present inventor has found these defects and invented the present cassette type hygienic comb and brush.

SUMMARY OF THE INVENTION

The object of the present invention is to provide a hygienic comb and brush wherein a cassette bristle holder, having a plurality of thin film layers removably held atop thereon with the bristles extending through the layers, is engaged with the back of comb or brush for cleansing or combing use and may be replaced with a new cassette bristle holder for continuous service after the thin film layers being completely torn off.

BRIEF DESCRIPTION OF THE DRAWINGS

FIG. 10 is still another preferred embodiment of the present invention in which bristles are partially shown.

FIG. 10*a* is a sectional drawing of FIG. 10.

FIG. 11 is further preferred embodiment of the present invention in which bristles are omitted.

FIG. 12 is a side-view sectional drawing after assembling the comb of FIG. 11.

FIG. 13 is an illustration showing the bristle holder as laid open.

DETAILED DESCRIPTION

Figure 1:
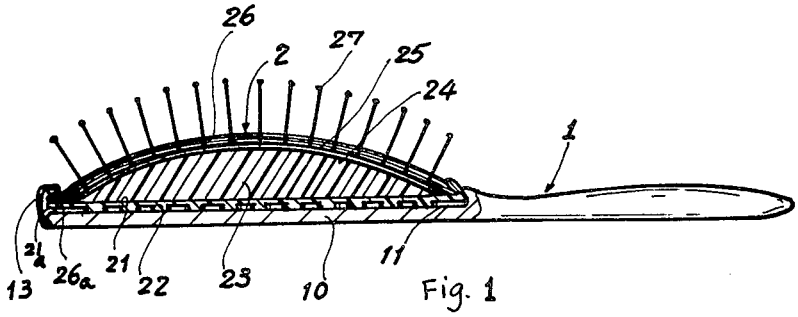
FIG. 1 is a partial sectional drawing of the present invention.
Figure 2:
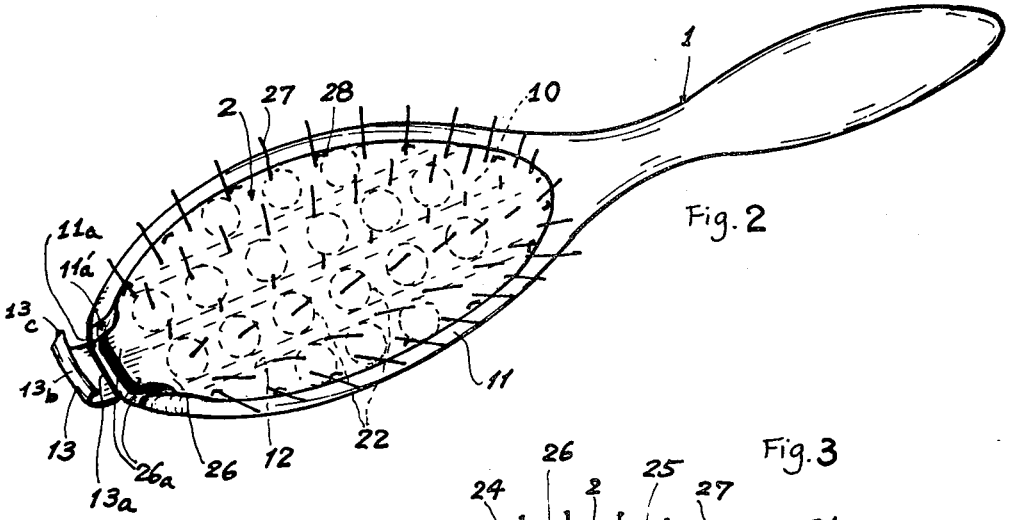
FIG. 2 is a perspective drawing of the present invention.
Figure 3:
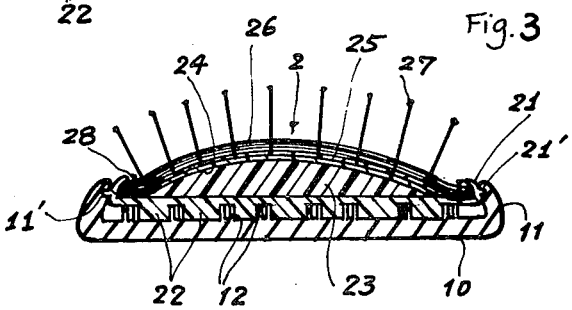
FIG. 3 is a side-view sectional drawing of the cassette bristle holder of the present invention.

As shown in FIG. 1, FIG. 2 and FIG. 3, the present invention comprises a basic body 1 and a cassette bristle holder 2.

Said basic body 1 comprises a handle portion and a back portion 10. Said back portion 10 is formed with a rim 11 along the periphery of said back 10. Said back 10 is formed several parallel double-grates 12 within said rim 11. A horizontally hinged rim cap 13 is provided on the front portion of said back 10 to pivotedly close the opening 11*a* which is formed by cutting the front portion of said rim 11. Two sockets 11'*a* are formed on both sides of said opening 11*a*. Said rim cap 13 comprises a hinge 13*a* which is fixed lowerly on the front end of said back 10, a hook portion 13*b* and two balls 13*c* each engaged with each socket 11'*a*.

Said cassette bristle holder 2 comprises a bristle base 21, a plurality of cylindrical extensions 22 extending under said base 21, an arcuated foam cushion 23 (such as made from foamed poly-styrene), a sponge lining 24, a rubber lining 25, a plurality of thin film layers 26, bristles 27 extending through the layers, and several fixing nails 28.

Figure 6:
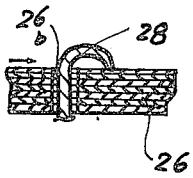
FIG. 6 is a partial sectional drawing of the fixing nails of the present invention.

Said bristle base 21 is formed thereunder with cylindrical extensions 22 which engage with the double-grates 12 formed on said back portion 10. The periphery of said base 21 is smoothly developed from the rim 11 of said body 1. Said foam cushion 23 is formed as an arcuated form as FIG. 3 shown, on which said sponge lining 24, said rubber lining 25 and the thin film layers 26 can be held atop thereon so that the edges of the linings and layers can be fixed with said base 21 by said fixing nails 28. Said nail 28, as shown in FIG. 6, can be bent at its upper portion to resiliently stabilize all the thin layers 26. A nail hole 26*b* is formed on each thin layer to pass said nail 28 as figure shown to facilitate the tearing operation of each thin layer 26.

Each of said thin layers 26 is formed a tongue portions 26*a* on its front end and a tongue portion 21*a* is correspondingly formed under said film tongue 26*a*. Both tongue portions 26*a*, 21*a* extend to said opening 11*a* of said rim 11. Said rim cap 13 serves to cover said tongue portions 26*a*, 21*a* for pretty appearance of the present invention.

Said bristle base 21 can be formed with extension 21' on its periphery to engage with the groove 11' formed within said rim 11 for more stable engagement of said holder 2 with said body 1.

Figure 4:
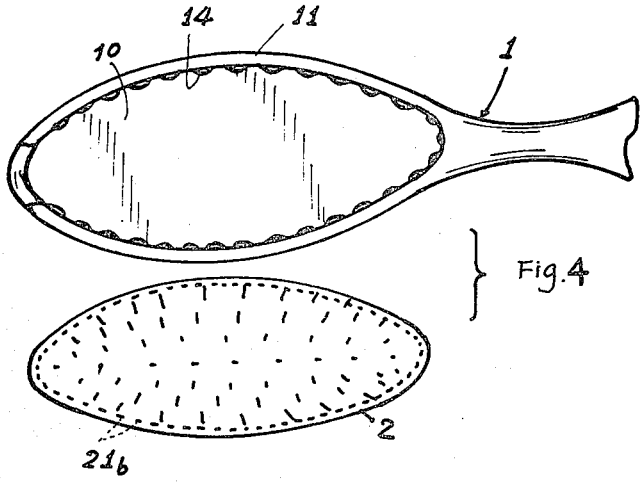
FIG. 4 is an illustration showing another engagement of the bristle holder with the comb body in accordance with the present invention.
Figure 5:
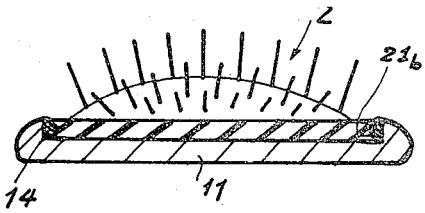
FIG. 5 is a side-view sectional drawing after assembling the parts of FIG. 4.

Another preferred embodiment of the present invention is shown in FIG. 4 and FIG. 5. A ball race 14 is fixed into said rim 11 to engage with said cassette bristle holder 2 having a recess groove 21*b* along the periphery of its base 21. Such an engagement method may replace the afore-mentioned one as shown in FIG. 2 and FIG. 3.

Figure 5A:
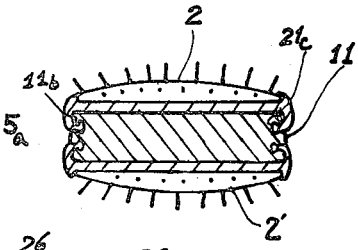
FIG. 5*a* shows a partial sectional drawing of still another engagement of the bristle holder with the comb body of the present invention.

Still another engagement of the bristle holder with the comb body is shown in FIG. 5*a* in that said rim 11 is formed with two grooves 11*b* to engage with two sliding extensions 21*c* formed on both sides of said bristle base 21. Said bristle holder 2 can be withdrawn from said body 1 or inserted thereto by sliding said extensions 21c along said grooves 11b to replace the afore-mentioned engagement methods. Such an engagement method may be applied in single bristle holder as shown in FIG. 1 or dual bristle holders as shown in FIG. 8.

Figure 7:
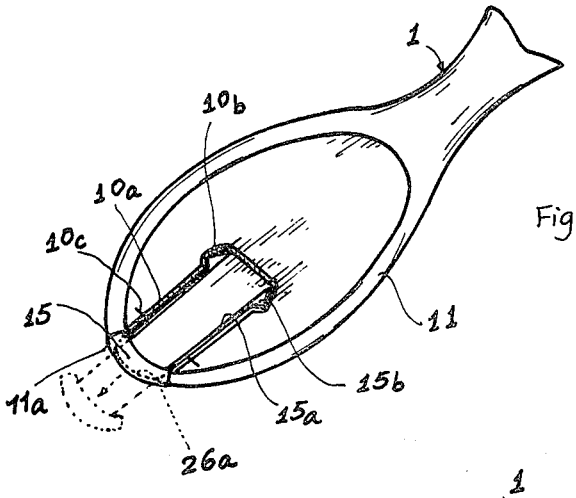
FIG. 7 is an illustration showing another type of rim cap in accordance with the present invention.

As FIG. 7 shown, said rim cap 13 can be substituted with another rim cap as drawer type 15. Said rim cap 15 comprises two spring legs 15a each having a slope block 15b to poke into the recess corner 10b formed on said back 10. Said back 10 is formed a longitudinal groove 10a to guide said legs 15a for withdrawing said cap 15. Two stopping plates 10c are respectively formed on both sides of said groove 10a (near the opening 11a) to stop said cap 15 without being released therefrom.

Figure 8:
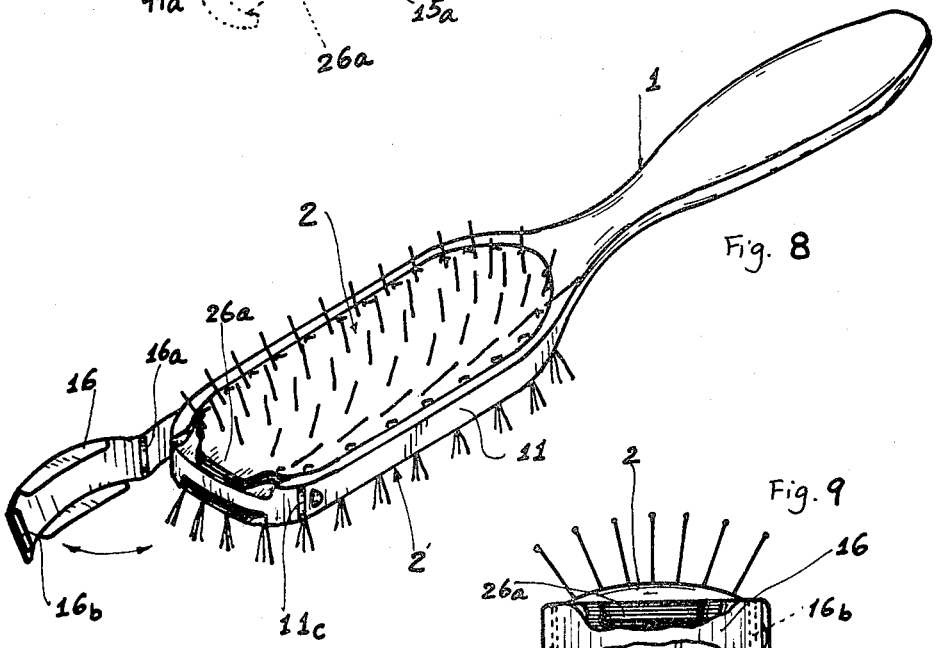
FIG. 8 is an illustration of another preferred embodiment of the present invention.
Figure 9:
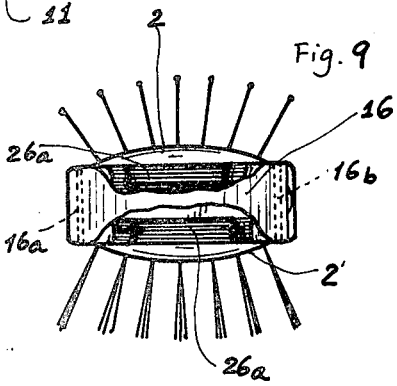
FIG. 9 is a side-view sectional drawing of FIG. 8.

Another preferred embodiment of the pressent invention is shown in FIG. 8 and FIG. 9. A comb is made as dual type comprising an upper bristle holder 2 and a lower holder 2' each being inserted into said rim 11. Said rim cap 16 is made as door type comprising a hinge 16a which can be simplified as a longitudinal groove as figure shown and is pivotedly connected on one side of said rim openings, and a locking extension 16b which engages with a recess groove 11c formed on another side of said rim opening so that said cap 16 can be closed on said rim 11 to cover all tongue portions 26a of the thin layers 26 for pretty appearance of the present invention.

When using the present invention after a time, said rim cap 13, 15, 16 can be opened and a thin film layer can be torn off to remove the dust or hair accumulated on the bristles 27 without touching the dirts so that a new layer will be revealed ready for fresh service. After completely tearing off all the layers 27, a new cassette bristle holder 2, 2', 2a can be inserted into said rim 11 for repeated service of the comb or brush.

Still another preferred embodiment of the present invention is shown in FIG. 10 and FIG. 10a in which a flare type comb or brush is disclosed by inserting a cylindrical cassette bristle holders 2 into a spindle 17 of said body 1. Said spindle 17 of said body 1 is formed with a female-threaded hole 17a on its open end. The open end of said spindle 17 is cut with two arcuated holes 18. Two extreme surfaces 18a are formed to stop a cap 19 which comprises a male-threaded plug 19a engaged with said hole 17a of said spindle 17 and a cap extension 19b covering the thin layers 2b.

Said cassette holder 2 comprises a cylindrical base 2a inserted into said spindle 17 and a plurality of thin film layers 2b removably held on said base 2a with bristles extending therethrough. One side of each said thin layer 2b is formed with a perforation line 2c. A boundary 2d of the two open ends of the thin layers 2b is formed at the opposite side of said perforation line 2c. Each end of said layer 2b beside said boundary 2d is fixed onto said base 2a by several fixing nails 2e. Each said thin layer 2b can be formed with tongue portion (not shown) corresponding to said hole 18 for easily tearing off the layer. When tearing the thin layer, the cap 19 can be opened and the film can be easily torn from the film edge outside said arcuated hole 18 along the perforation line 2c and the boundary 2d.

Further embodiment of the present invention is shown in FIG. 11 and FIG. 12 to disclose a semi-circular flare type comb or brush. Such a comb or brush comprises a bar body 3 and a cylindrical cassette bristle holder 4. Said bar body 3 extends a hollow spindle 31 from its handle portion. Said spindle 31 is formed a longitudinal slit 31a thereon and is formed with a female thread 31b on its open end. A terminal cap 32 is provided with male-threaded plug 32a to engage with the female thread 31b of said spindle 31. A groove 32b is formed on the cap 32. A longitudinal cover 33 is pivotedly connected on the handle portion by a pivot 3a and is formed an extension tip 33a on its free end to engage with the groove 32b to cover the opening ends 43a of the thin film layers 43 as FIG. 12 shown.

Said cylindrical cassette bristle holder 4 comprises a bristle base 41 having bending ends 42 to be inserted into said hollow spindle 31 through a slit 31a, a plurality of thin film layers 43 removably held atop on said base 41, bristles 44 extending through the layers 43 and several fixing nails 45 fixing both ends of each said thin film layer. The opening end 43a of each said thin film layer 43 is overlapped on another end 43b of the layers 43. Said bristle base 2a may comprise a plastic substrate and a rubber cushion adhered thereon.

When using such a comb or brush, said cover 33 can be opened and the opening end 43a can be pulled to tear the layer 43 along the perimeter of said holder 4 to remove the layer containing the dirts. After using up the layers 43, the used holder 4 can be withdrawn and another new holder 4 can be inserted into said spindle 31 of said body 3 and said cover 33 is recovered to cover the ends of said thin layers 43 for sound appearance.

The flare type comb and brush of FIG. 10 may utilize the principles of the embodiment as shown in FIG. 11. FIG. 13 shows the bristle holder as laid open in that both ends can be tapered for easily tearing the film.

The present invention has the following advantages superior to any conventional comb or brush:

1. Said cassette bristle holder can be replaced with the new one after completely tearing off all the thin film layers held thereon for repeated use of the present invention for economic reason.

2. Each thin film layer can be torn off to remove the accumulated hair, dust or dirts without contaminating user's fingers.

3. The appearance of the present comb or brush, even containing the removable thin film layers, is similar to conventional comb or brush, that is, the outer structure of the present invention may be the same as any conventional one, however, the present invention may provide the special functions by the thin film layers as above-mentioned.

4. The thin film layer is limited within the rim of said comb back so that the film can be easily torn and the present invention can be easily made by mass production.

I claim:

1. A cassette type hygienic comb and brush comprising: a basic body (1) having a handle portion and a back portion (10) extending from the handle portion; and a cassette bristle holder (2) having a plurality of thin film layers (26) removably held atop on a bristle base (21) engaged with the back portion (10) of said basic body (1), and having plurality of bristles (27) extending from said bristle base (21) through said thin film layers so that the uppermost layer can be torn to remove the dirts accumulated thereon and said cassette bristle holder can be replaced with the new holder after completely tearing off said thin film layers therefrom.

2. A cassette type hygienic comb and brush according to claim 1, wherein said back portion (10) of said basic body is formed with a rim (11) and formed with several parallel double-grates (12) within said rim (11) to engage with said bristle base (21) of said cassette bristle holder (2), said rim (11) being cut on its front portion to form an opening (11*a*) and a horizontally hinged rim cap (13) being provided to cover said opening on said rim.

3. A hygienic comb and brush according to claim 1, wherein said cassette bristle holder comprises a bristle base (21) formed with plurality of cylindrical extensions (22) thereunder to engage with said double-grates (12) of said back portion, an arcuated foam cushion (23) bound on said bristle base (21), a sponge lining (24) packed on said cushion, a rubber lining (25) adhered on said sponge lining, a plurality of thin film layer (26) removably held on said rubber lining (25) and a plurality of bristles (27) extending from said rubber lining through said layers, and several fixing nails (28) fixing said thin film layers onto said bristle base.

4. A hygienic comb and brush according to claim 1, wherein each of said thin film layer (26) and said bristle base (21) extends a tongue portion (26*a*, 21*a*) on said rim opening and can be covered by said rim cap (13).

5. A hygienic comb and brush according to claim 1, wherein said back of said comb body is formed a ball race (14) inside said rim (11) and said base of said cassette bristle holder (2) is formed with a recess groove (21*b*) to engage with said ball race (14).

6. A hygienic comb and brush according to claim 1, wherein said rim of said body is formed with two grooves (11*b*) to engage with two sliding extensions (21*c*) formed on both sides of said bristle base (21) of said cassette bristle holder.

7. A hygienic comb and brush according to claim 1, wherein said rim cap (15) is made as drawer type and comprises two spring legs (15*a*) each having a slope block (15*b*) to poke into the recess corner (10*b*) formed on said back portion which is formed a longitudinal groove (10*a*) to guide said legs for withdrawing said cap.

8. A hygienic comb and brush according to claim 1, wherein said comb and brush is made as dual type comprising an upper bristle holder and a lower holder each being inserted into said rim; said rim cap (16), being made as door type, which comprises a hinge (16*a*) pivotedly connected on one side of said rim opening and a locking extension (16*b*) engaging with a recess groove (11*c*) formed on another side of said rim opening so that said rim cap can be closed to cover all tongue portions of said thin film layers.

9. A hygienic comb and brush according to claim 1, wherein said basic body is made as round bar having a round handle portion and a spindle (17), extending from said handle portion, which is formed with a female-threaded hole (17*a*) on its open end and cut with two arcuated holes (18) on the open end to reveal two extreme surfaces (18*a*) to stop a cap (19) plugged into said hole; and said cassette bristle holder (2) is made as cylindrical shape as comprising a cylindrical base (2*a*) and a plurality of thin film layers (2*b*) removably held atop said base with bristles extending therethrough, each said thin film layer being formed a perforation line (2*c*) on one side thereof and a boundary (2*d*) being formed on the opposite side of said perforation line, each end of said thin film layer beside said boundary being fixed onto said base by several fixing nails (2*e*), said cassette bristle holder being fixed into said spindle of said body by a cap (19) having male threaded plug (19*a*) engaged with the female-threaded hole (17*a*) formed in said spindle (17).

10. A hygienic comb and brush according to claim 9, wherein said spindle (31) is formed as a hollow spindle having longitudinal slit (31*a*) and formed with a female thread on its open end (31*b*); and said cylindrical cassette bristle holder (4) comprises a bristle base (41) having bending ends (42) inserted into said hollow spindle (31) through said longitudinal slit, a plurality of thin film layers (43) removably held atop on said bristle base with bristles (44) extending therethrough and several fixing nails (45) fixing both ends of said thin film layers, said cylindrical cassette bristle holder being fixed into said spindle by a terminal cap (32) which is formed a recess thereon to engage an extension tip formed on the free end of a longitudinal cover (33) pivotedly connected on the handle portion to cover the opening ends of said thin film layers.

* * * * *